US009790941B2

(12) United States Patent
Sun et al.

(10) Patent No.: US 9,790,941 B2
(45) Date of Patent: Oct. 17, 2017

(54) COMPRESSOR AND BEARING ASSEMBLY

(71) Applicant: Emerson Climate Technologies, Inc., Sidney, OH (US)

(72) Inventors: Wei Sun, West Chester, OH (US); Harry Clendenin, Sidney, OH (US); Pankaj Nimbaji Ahire, Pune (IN); Pavankumar Jorwekar, Pune (IN); Ramprasad Ramaswamy, Pune (IN); Vinayak Juge, Pune (IN)

(73) Assignee: Emerson Climate Technologies, Inc., Sidney, OH (US)

( * ) Notice: Subject to any disclaimer, the term of this patent is extended or adjusted under 35 U.S.C. 154(b) by 253 days.

(21) Appl. No.: 14/551,515

(22) Filed: Nov. 24, 2014

(65) Prior Publication Data

US 2015/0354571 A1 Dec. 10, 2015
US 2016/0369802 A9 Dec. 22, 2016

Related U.S. Application Data

(60) Provisional application No. 61/909,766, filed on Nov. 27, 2013.

(30) Foreign Application Priority Data

Jun. 4, 2014 (IN) ..... 1835/MUM/2014

(51) Int. Cl.
*F01C 1/02* (2006.01)
*F03C 2/00* (2006.01)
(Continued)

(52) U.S. Cl.
CPC ..... *F04C 29/0071* (2013.01); *F04C 18/0207* (2013.01); *F04C 18/0215* (2013.01); *F04C 18/0253* (2013.01); *F04C 29/0078* (2013.01); *F04C 23/008* (2013.01); *F04C 2240/50* (2013.01); *F04C 2240/802* (2013.01)

(58) Field of Classification Search
CPC ..... F04C 18/0215; F04C 18/2016; F04C 18/0253; F04C 18/0207; F04C 23/008; F04C 27/005; F04C 29/0071; F04C 29/0057; F04C 2240/30; F04C 2240/50;
(Continued)

(56) References Cited

U.S. PATENT DOCUMENTS 6,352,417 B1 3/2002 Zamudio et al.
2003/0152472 A1 8/2003 Kiem et al.
2015/0354571 A1 12/2015 Sun et al.

FOREIGN PATENT DOCUMENTS

CN 1436933 A 8/2003
CN 202579197 U 12/2012
(Continued)

OTHER PUBLICATIONS

First Office Action and Search Report regarding Chinese Patent Application No. 20141070554.7, dated May 3, 2016. Translation provided by Unitalen Attorneys at Law.

*Primary Examiner* — Theresa Trieu
(74) *Attorney, Agent, or Firm* — Harness, Dickey & Pierce, P.L.C.

(57) ABSTRACT

A compressor is provided and may include a shell, a hub, an insert, and at least one collar. The hub may be disposed within the shell and define an axis of rotation. The hub may include an axially extending aperture. The insert may be disposed within the aperture. The at least one collar may be disposed about the hub.

21 Claims, 10 Drawing Sheets

(51) Int. Cl.

| | |
|---|---|
| ***F03C 4/00*** | (2006.01) |
| ***F04C 2/00*** | (2006.01) |
| ***F04C 29/00*** | (2006.01) |
| ***F04C 18/02*** | (2006.01) |
| *F04C 23/00* | (2006.01) |

(58) Field of Classification Search
CPC ..... F04C 18/0426; F04C 29/0078; F04C 2240/802
USPC ..... 418/55.1–55.6, 57, 88
See application file for complete search history.

(56) References Cited

FOREIGN PATENT DOCUMENTS

| | | | |
|---|---|---|---|
| CN | 204436734 | U | 7/2015 |
| EP | 1275849 | A2 | 1/2003 |

COMPRESSOR AND BEARING ASSEMBLY

CROSS-REFERENCE TO RELATED APPLICATIONS

This application claims the benefit and priority of Indian Patent Application No. 1835/MUM/2014, filed on Jun. 4, 2014, and U.S. Provisional Application No. 61/909,766, filed on Nov. 27, 2013. Indian Patent Application No. 1835/MUM/2014 also claims the benefit and priority of U.S. Provisional Application No. 61/909,766, filed on Nov. 27, 2013. The entire disclosures of each of the above applications are incorporated herein by reference.

FIELD

The present disclosure relates to a compressor, and more particularly to a compressor having a bearing retention feature.

BACKGROUND

This section provides background information related to the present disclosure and is not necessarily prior art.

Scroll compressors are used in applications such as refrigeration systems, air conditioning systems, and heat pump systems to pressurize and, thus, circulate refrigerant within each system.

As the scroll compressor operates, an orbiting scroll member having an orbiting scroll member wrap orbits with respect to a non-orbiting scroll member having a non-orbiting scroll member wrap to make moving line contacts between flanks of the respective scroll wraps. In so doing, the orbiting scroll member and the non-orbiting scroll member cooperate to define moving, crescent-shaped pockets of vapor refrigerant. A volume of the fluid pockets decreases as the pockets move toward a center of the scroll members, thereby compressing the vapor refrigerant disposed therein from a suction pressure to a discharge pressure.

Scroll compressors may include a bearing housing that houses a drive bearing assembly. The drive bearing assembly often includes a steel-backed insert (e.g., press-fit) that can rotate relative to the bearing housing under certain severe operating conditions. This relative rotation often causes undesirable movement of the insert, and may eventually cause the insert to "walk out" of the bearing housing.

SUMMARY

This section provides a general summary of the disclosure, and is not a comprehensive disclosure of its full scope or all of its features.

A compressor constructed in accordance with one example of the present disclosure can include a shell, a hub, an insert, and at least one collar. The hub may be disposed within the shell and define an axis of rotation. The hub may include an axially extending aperture. The insert may be disposed within the aperture. The at least one collar may be disposed about the hub.

A compressor constructed in accordance with another example of the present disclosure can include a shell, a bearing housing, an insert, and at least one collar. The bearing housing may be disposed within the shell and include a central hub defining an axis of rotation. The central hub may include a first axially extending portion having a first wall thickness and a second axially extending portion having a second wall thickness. The insert may be concentrically disposed within the central hub. The at least one collar may be concentrically disposed about the second axially-extending portion.

A compressor constructed in accordance with yet another example of the present disclosure can include a shell, a support structure, an insert and at least one collar. The support structure may be disposed within the shell and include a central hub defining an axis of rotation. The central hub may include a first axially extending portion having a first outer diameter, and a second axially extending portion having a second outer diameter. The insert may be concentrically disposed within the central hub. The at least one collar may be concentrically disposed about the second axially-extending portion.

The drive shaft can be rotatably mounted within the insert.

In accordance with an embodiment of the present disclosure, the arresting arrangement is an annular collar having an inner diameter, and the hub has a step portion configured on outer periphery thereof such that an outer diameter of the step portion is larger than the inner diameter of the annular collar for configuring interference fit between the annular collar and the step portion to urge the hub towards the insert to apply reinforcement on the insert.

In accordance with another embodiment, the arresting arrangement includes a tapered lock nut and a retaining ring, the insert is functionally coupled to the retainer ring having protruding legs that engage with inner periphery of the hub to configure interference fit between the hub and the retainer ring and the lock nut engages with threads formed on outer periphery of the hub to securely hold the retainer ring and accordingly the insert within the hub.

In accordance with still another embodiment, the arresting arrangement is a collar that press fits over the hub and urges the hub towards the insert to apply reinforcement on the insert, thereby restraining movement of the insert with respect to the hub.

In accordance with another embodiment, the arresting arrangement includes a step configured on an inside wall of the hub such that the insert snap fits into the step configured on inside wall of the hub, thereby restraining movement of the insert with respect to the hub.

The collar can be press-fit on the hub.

Generally, the insert is a cylindrical insert having an outer diameter, and the aperture has an inner diameter that is smaller than the outer diameter.

The insert can be press-fit within the aperture.

Further, the insert is operable to rotate within the aperture about the axis of rotation.

The hub may further include an axially extending recessed portion disposed about the aperture, and wherein the collar is disposed about the recessed portion.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 9A:
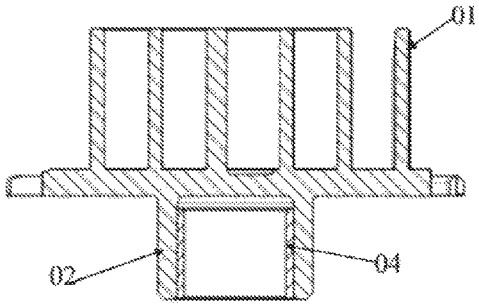
FIGURE 9a (Prior Art)
Figure 9B:
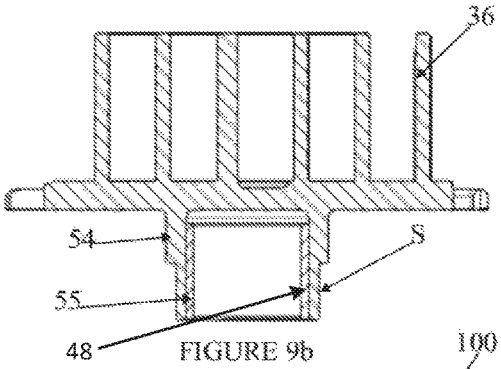
Figure 9C:
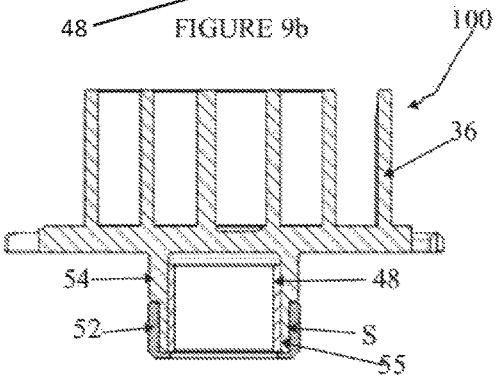

FIG. 9*a* illustrates a cross-sectional view of an orbiting scroll member of a compressor with a hub extending therefrom, wherein a bearing insert is press fitted inside an axially extending aperture of the hub of the orbiting scroll member in accordance with the prior art;

FIG. 9*b* illustrates a cross-sectional view of an orbiting scroll member of a compressor with a hub extending therefrom, wherein the hub has a step configured on its outer end for facilitating mounting of a bearing collar thereon in accordance with an embodiment of the present disclosure, further, the hub includes an axially extending aperture for receiving a bearing insert therein;

FIG. 9*c* illustrates an assembly of a bearing collar on the stepped end of the hub of the orbiting scroll member of FIG. 9*b;*

Figure 10A:
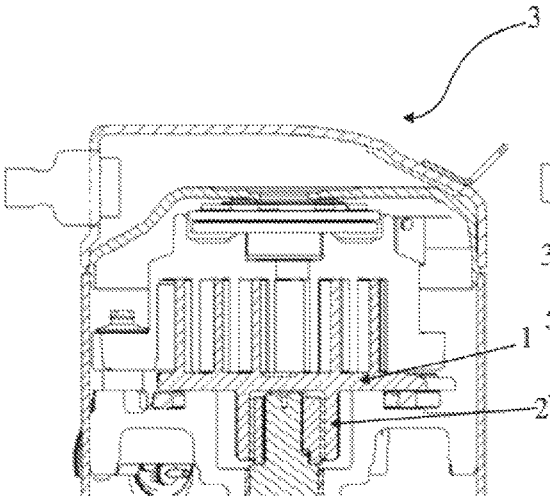
FIGURE 10a (Prior Art)

FIG. 10*a* illustrates a schematic representation of a compressor having the orbiting scroll member with the hub extending therefrom in accordance with the prior art as illustrated in FIG. 9*a;*

Figure 10B:
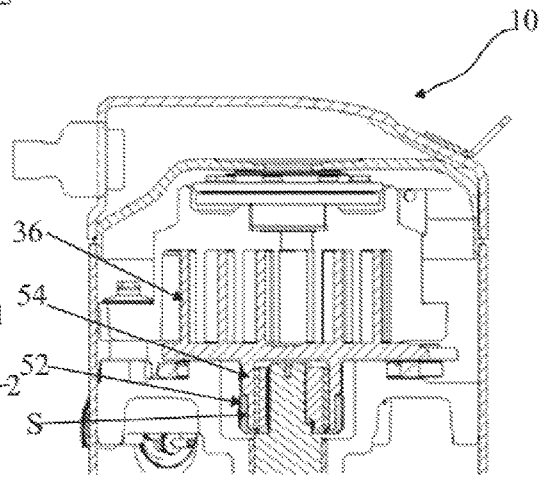

FIG. 10*b* illustrates a schematic representation of a compressor having the orbiting scroll member with the hub extending therefrom in accordance with the present disclosure as illustrated in FIG. 9*b;*

Figure 11A:
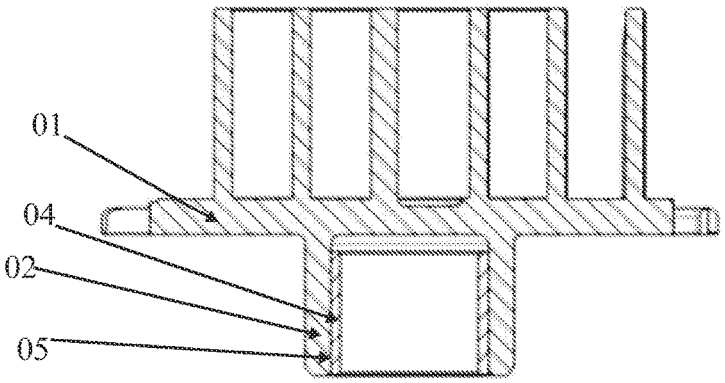
FIGURE 11a (Prior Art)
Figure 11B:
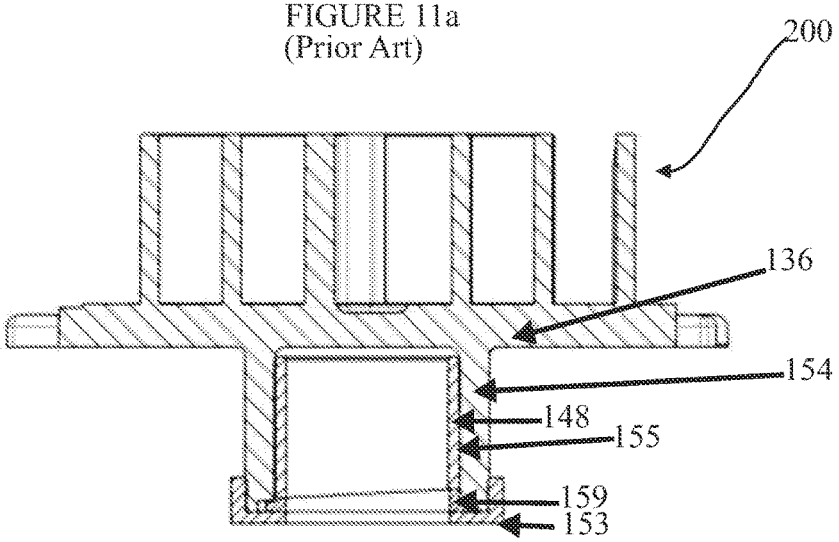
Figure 11C:
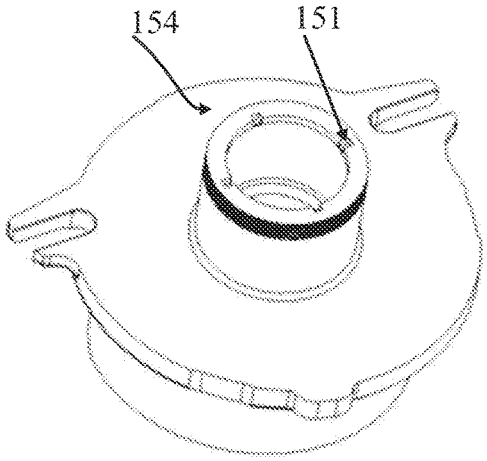
Figure 11D:
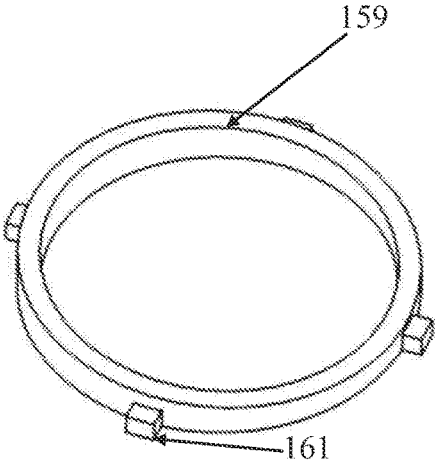
Figure 12A:
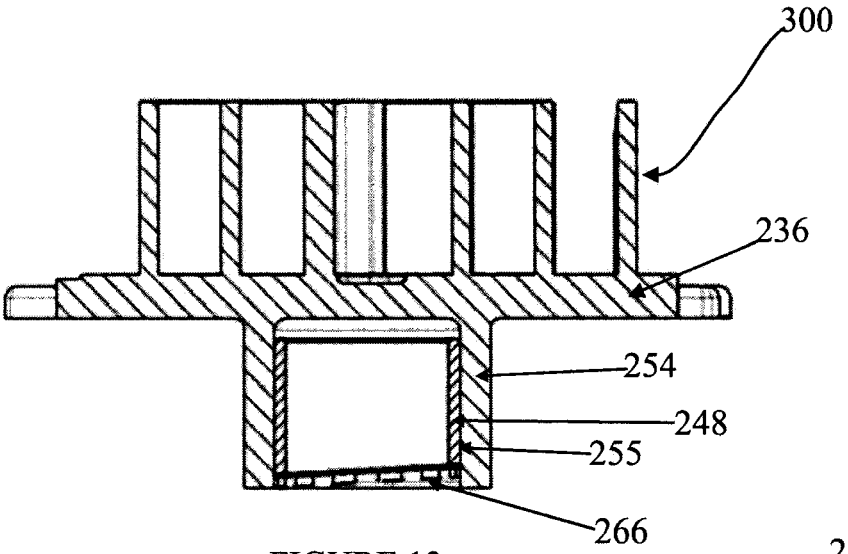
Figure 12B:
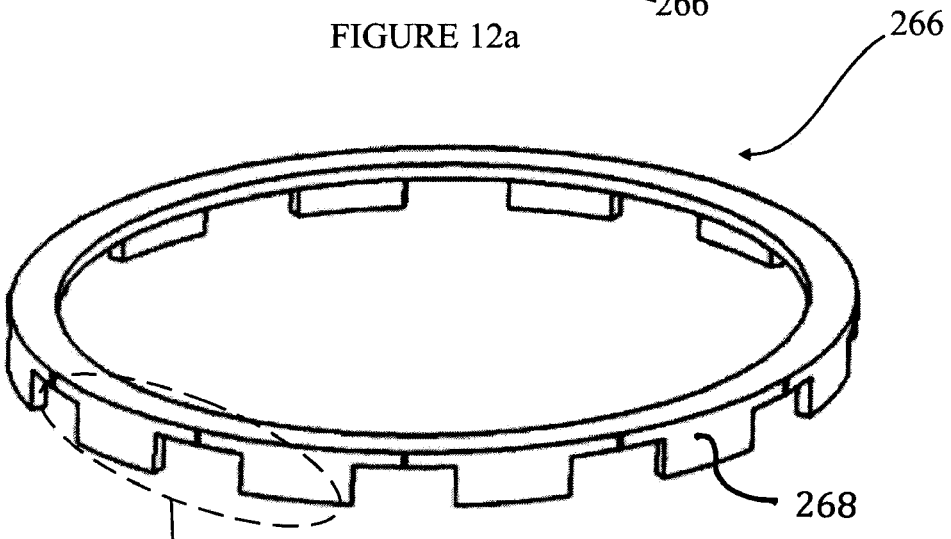
Figure 12C:
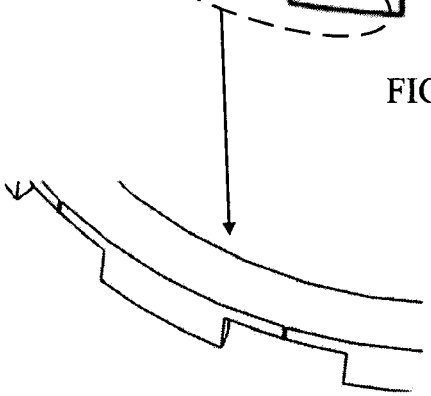
Figure 13:
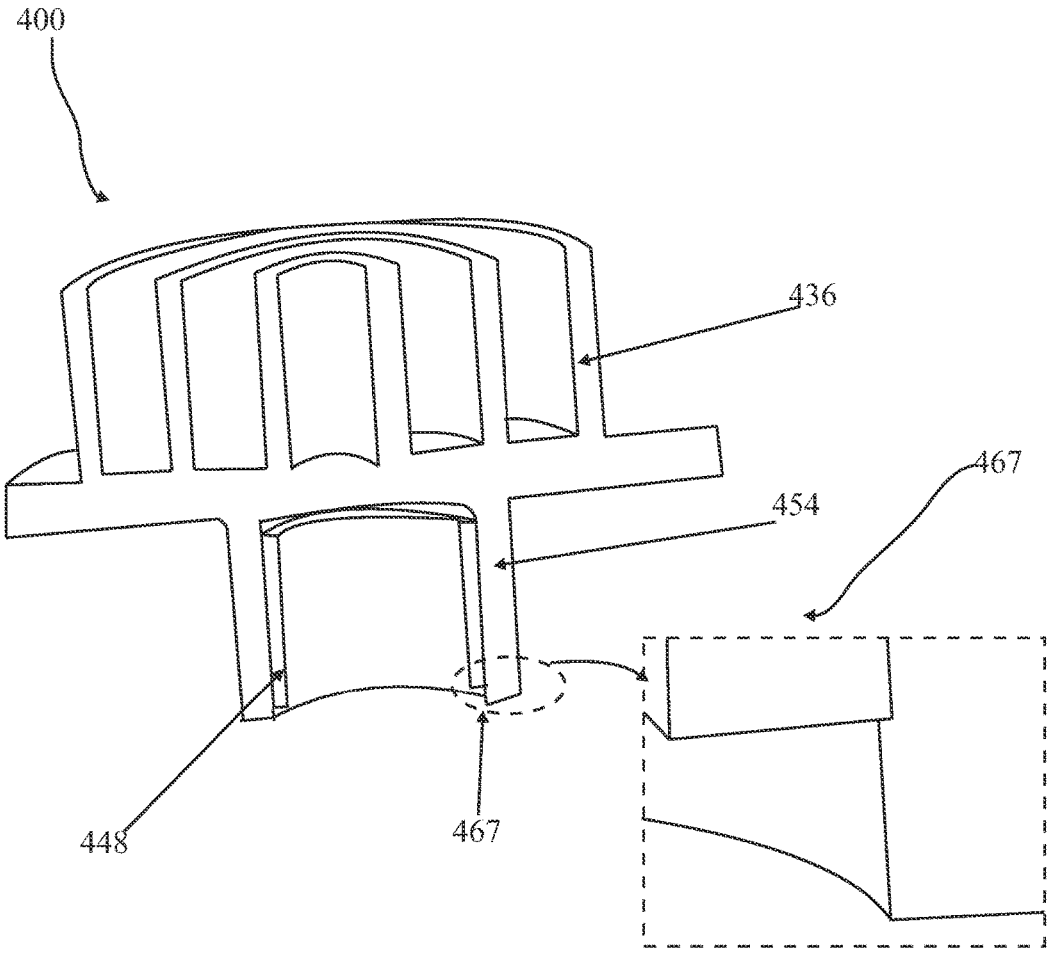

FIG. 11*a* illustrates a sectional view of the orbiting scroll member of a compressor with a hub extending therefrom and with a bearing insert assembled thereto in accordance with the prior art, wherein the bearing insert is press fitted into an axially extending aperture of the hub;

FIG. 11*b* illustrates a sectional view of an orbiting scroll member with a hub extending therefrom and a bearing insert received inside the axially extending aperture of the hub, particularly, a DU bearing is received in the axially extending aperture of the hub and a lock nut and a tapered retaining ring are mounted for retaining the bearing insert within the axially extending aperture;

FIG. 11*c* illustrates an enlarged view depicting the end portion of the hub of FIG. 11*b*, wherein the hub has a threaded end and slots are configured on the inside surface of the hub at the end of the hub for configuring arresting arrangement;

FIG. 11*d* illustrates an enlarged view of the retainer ring of FIG. 11*b*, wherein protruding legs are configured on the retainer ring that engage with the slots of the hub illustrated in FIG. 11*c* to configure an interference fit between the retainer ring and the hub;

FIG. 12*a* illustrates a sectional view of an orbiting scroll member of a compressor with a hub extending therefrom and a bearing insert received inside the axially extending aperture of the hub, wherein an elliptical retainer is used as an arresting arrangement in accordance with yet another embodiment;

FIG. 12*b* illustrates an isometric view of the elliptical retainer of FIG. 12*a*, wherein the elliptical retainer has legs/prongs that lock with scroll hub after assembly due to friction, the retainer ring also has micro projections between the legs;

FIG. 12*c* illustrates an enlarged view of the elliptical retainer of FIG. 12*b*, wherein the micro projections configured on the elliptical retainer are depicted; and FIG. 13 illustrates an isometric view of an arresting arrangement in accordance with yet another embodiment, wherein a step is provided at an inner bottom end of the hub extending from the orbiting scroll member and the bearing insert snap fits into the step configured at the bottom of the hub, thereby preventing bearing walk-out and walk-in.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 1:
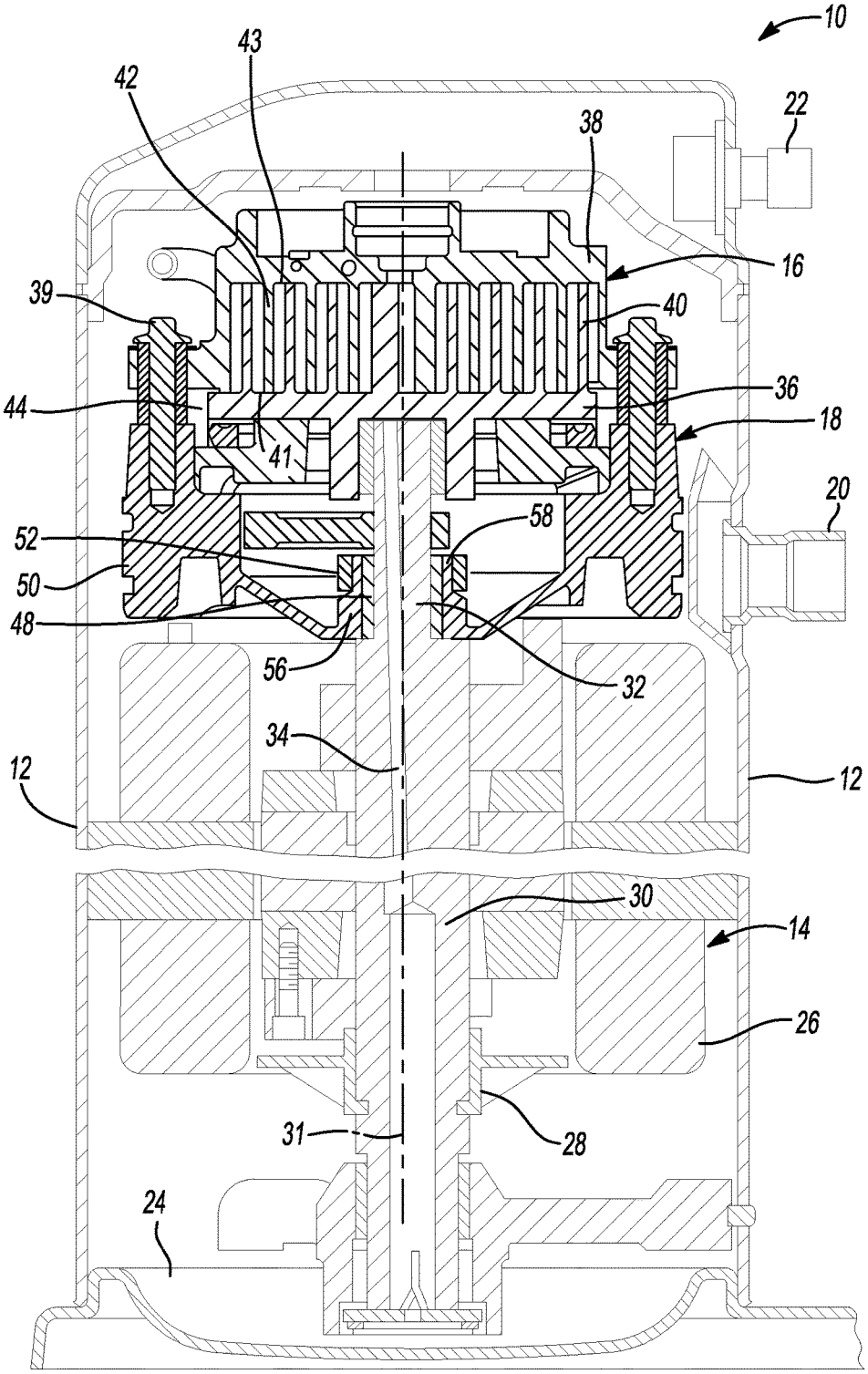
FIG. 1 is a cross-sectional view of a compressor in accordance with the present disclosure.

With reference to FIG. 1, a compressor 10 is shown to include a hermetic shell assembly 12, a motor assembly 14, a compression mechanism 16, and a bearing housing assembly 18. While the compressor 10 is generally described and shown herein as being a scroll compressor, it will be appreciated that the compressor 10 may be a reciprocating compressor within the scope of the present disclosure. The shell assembly 12 may house the motor assembly 14, the compression mechanism 16, and the bearing housing assembly 18. The shell assembly 12 may include a suction inlet port 20 receiving a working fluid at a suction pressure from one of an indoor and outdoor heat exchanger (not shown) and a discharge outlet port 22 discharging the working fluid to the other of the indoor and outdoor heat exchanger after it has been compressed by the compression mechanism 16. A bottom portion of the shell assembly 12 may form a reservoir or sump 24 containing a volume of a lubricant (e.g., oil).

The motor assembly 14 may include a motor stator 26, a rotor 28, and a drive shaft 30. The motor stator 26 may be press fit into the shell assembly 12. The rotor 28 may be press fit on the drive shaft 30 and may transmit rotational power to the drive shaft 30. The drive shaft 30 may rotate about an axis 31 and include an eccentric crank pin 32 drivingly engaging the compression mechanism 16. The drive shaft 30 may also include a lubricant passageway 34 extending therethrough and communicating with the lubricant sump 24.

The compression mechanism 16 may include an orbiting scroll member 36 and a non-orbiting scroll member 38. The non-orbiting scroll member 38 may be fixed to the bearing housing assembly 18 by a plurality of fasteners 39, such as threaded bolts or similar attachment features. The orbiting and non-orbiting scroll members 36, 38 include orbiting and non-orbiting spiral wraps 40, 42, respectively, that meshingly engage each other and extend from orbiting and non-orbiting end plates 41, 43, respectively. An Oldham coupling 44 may be keyed to the orbiting scroll member 36 and a stationary structure (e.g., the bearing housing assembly 18 or the non-orbiting scroll member 38) to prevent relative rotation between the orbiting and non-orbiting scroll members 36, 38 while allowing the orbiting scroll member 36 to move in an orbital path relative to the non-orbiting scroll member 38. Moving fluid pockets 46 are formed between the orbiting and non-orbiting spiral wraps 40, 42 that decrease in size as they move from a radially outer position to a radially inner position, thereby compressing the working fluid therein from the suction pressure to the discharge pressure.

Figure 2:
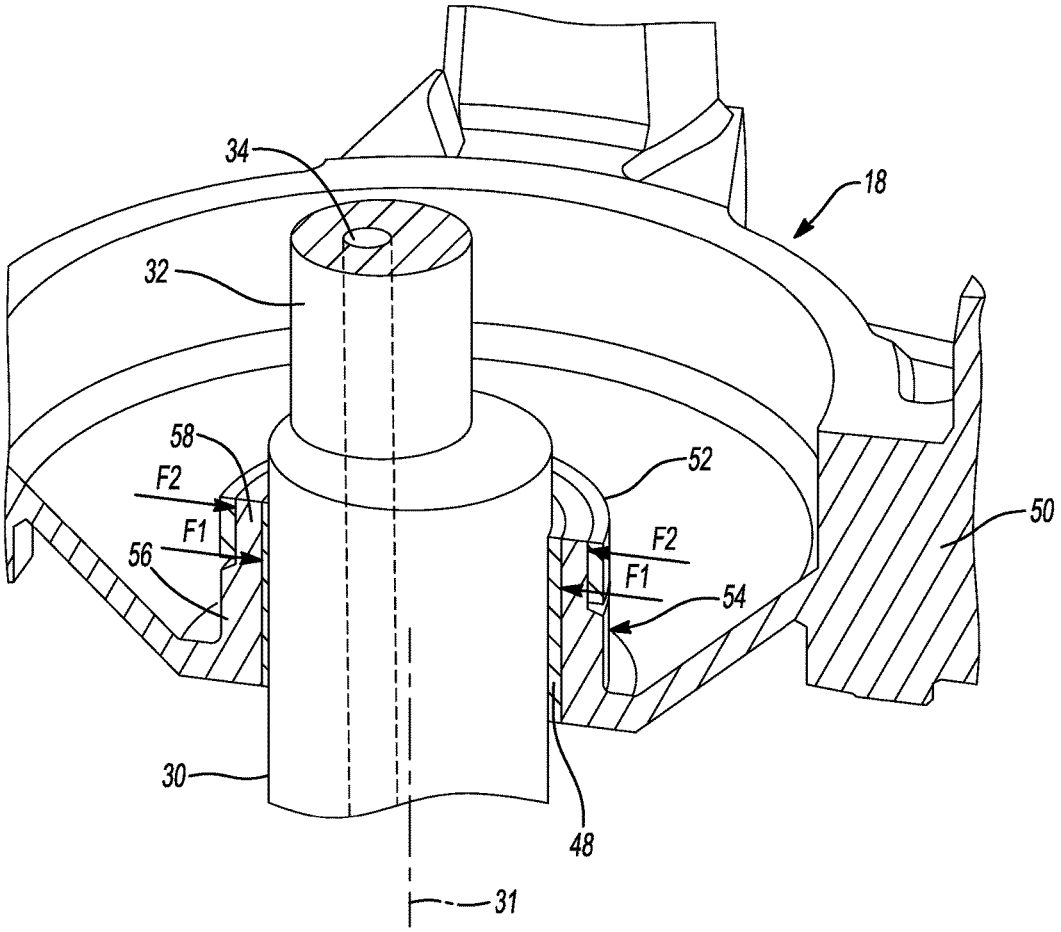
FIG. 2 is a partial cross-sectional view of a main bearing housing of the compressor of FIG. 1, including a bearing collar.

The bearing housing assembly 18 may include a bearing insert 48, a bearing housing 50, and at least one bearing collar 52. While the bearing housing 50 is generally shown and described herein as the first or main bearing housing 50, the bearing housing 50 may also be a second or drive bearing housing **50*a* within the scope of the present disclosure. The bearing housing 50 may be formed from cast iron or any other suitable material and may include a central hub 54 defining an axially-extending aperture 55. In one configuration, the aperture 55 may have an inner diameter D1. As illustrated in FIGS. 1 and 2, in one configuration, the central hub 54 may further include a first portion 56 and a second portion 58. The first and second portions 56, 58** may be integrally formed.

The first portion 56 may extend in the axial direction (relative to axis 31) from the bearing housing 50, and the second portion 58 may extend in the axial direction from the first portion 56. As illustrated, the first portion 56 may be substantially cylindrically shaped and define an outer diameter D2. The second portion 58 may be substantially cylindrically shaped and define an outer diameter D3.

Figure 3:
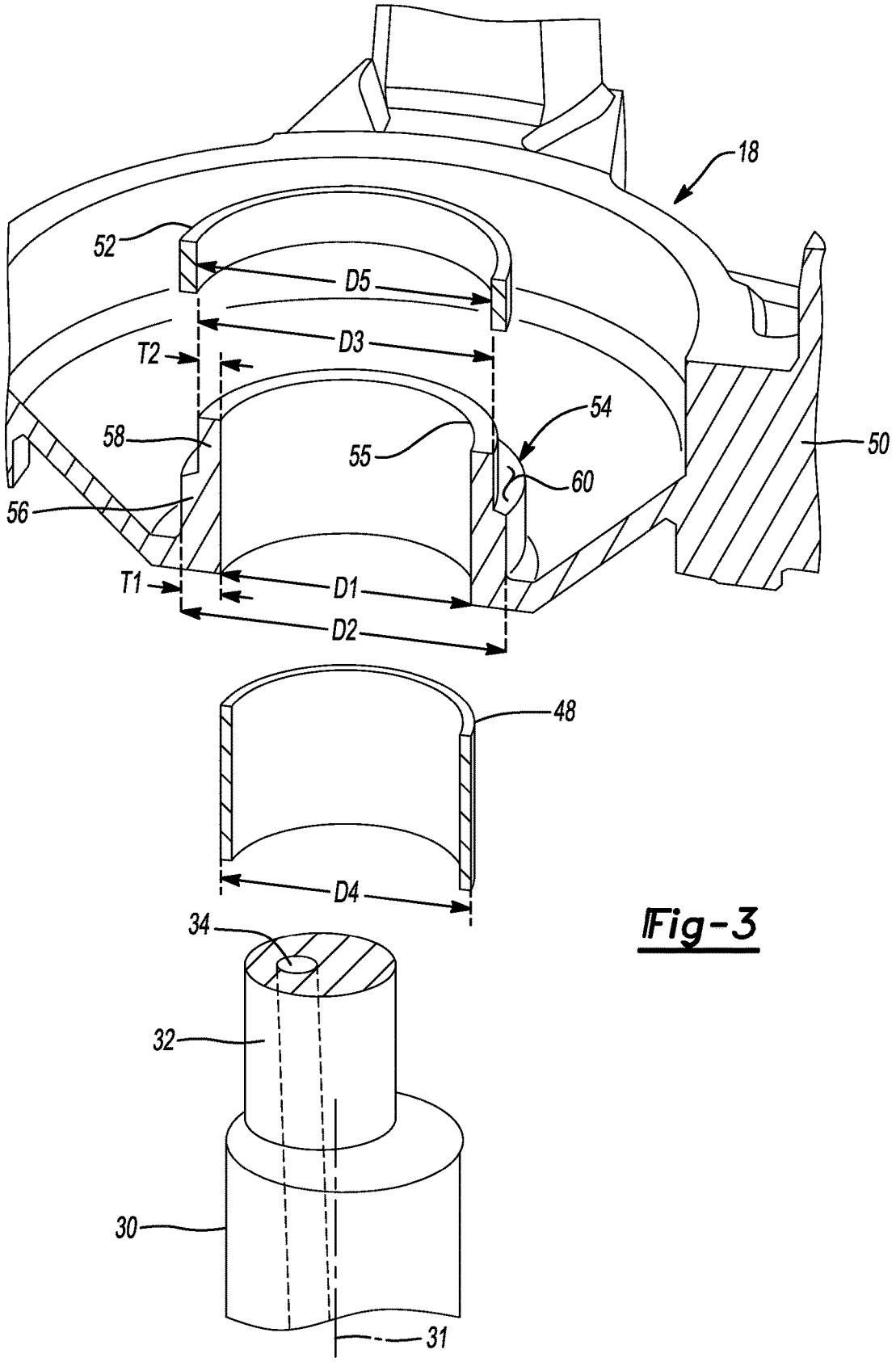
FIG. 3 is an exploded cross-sectional view of a main bearing housing of the compressor of FIG. 1, including a bearing collar.
Figure 6:
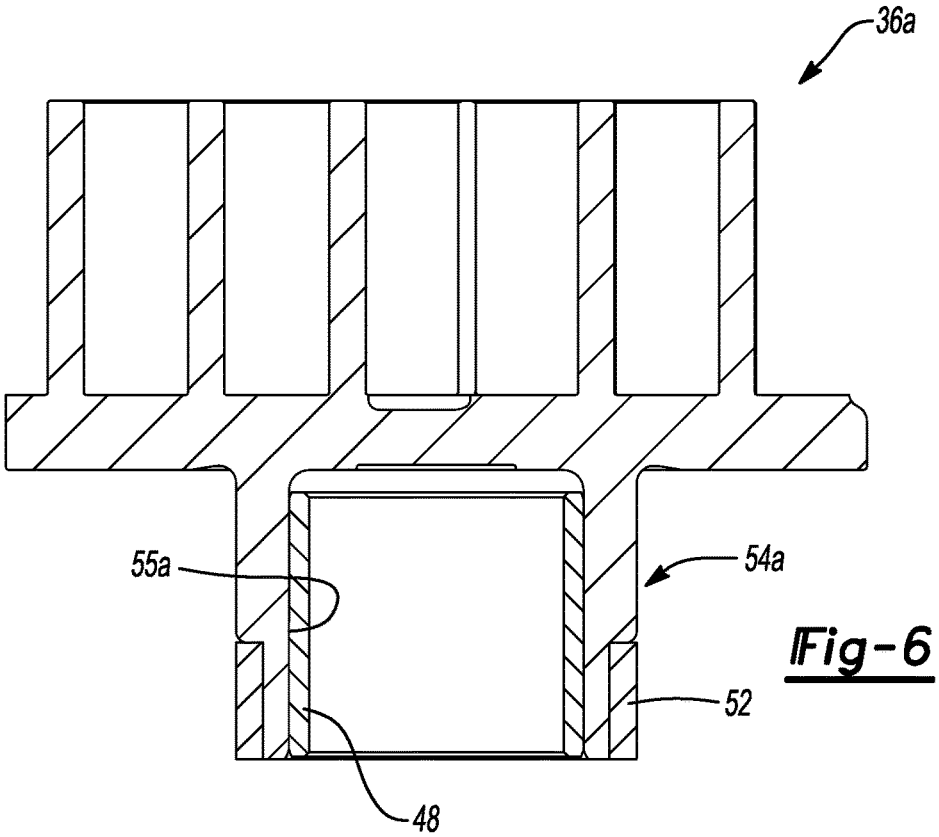
FIG. 6 is a partial cross-sectional view of an orbiting scroll member of the compressor of FIG. 1, including a bearing collar.

The first portion 56 may have a first wall thickness T1 and the second portion 58 may have a second wall thickness T2. The second wall thickness T2 may be less than or equal to the first wall thickness T1. In one configuration, the second wall thickness T2 may be thirty to fifty percent less than the first wall thickness T1. In another configuration, the second wall thickness T2 may be approximately forty percent less than the first wall thickness T1. Accordingly, the second portion 58 may define a circumferential or annular recessed portion of the central hub 54, including an angled surface 60 extending between and connecting the first portion 56 and the second portion 58. As illustrated, the angled surface 60 may be tapered, chamfered or otherwise provide a radiussed transition between the first portion 56 and the second portion 58. As illustrated in FIGS. 1-3, in one configuration the annular surface 60 may be frustoconically shaped. However, it will be appreciated that the angled surface 60 may extend at any angle between zero degrees and ninety degrees (FIGS. 6-7) relative to the axis 31. The annular surface 60 may help to axially support the bearing collar 52.

Figure 4:
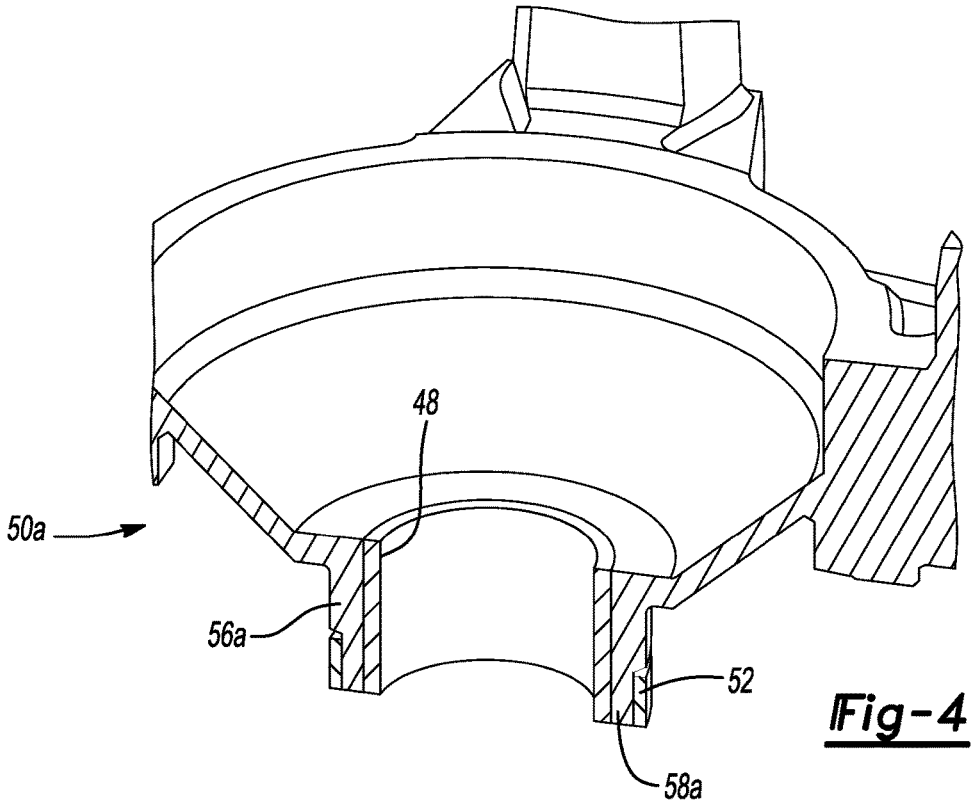
FIG. 4 is a partial cross-sectional view of another configuration of a main bearing housing of the compressor of FIG. 1, including a bearing collar.
Figure 5:
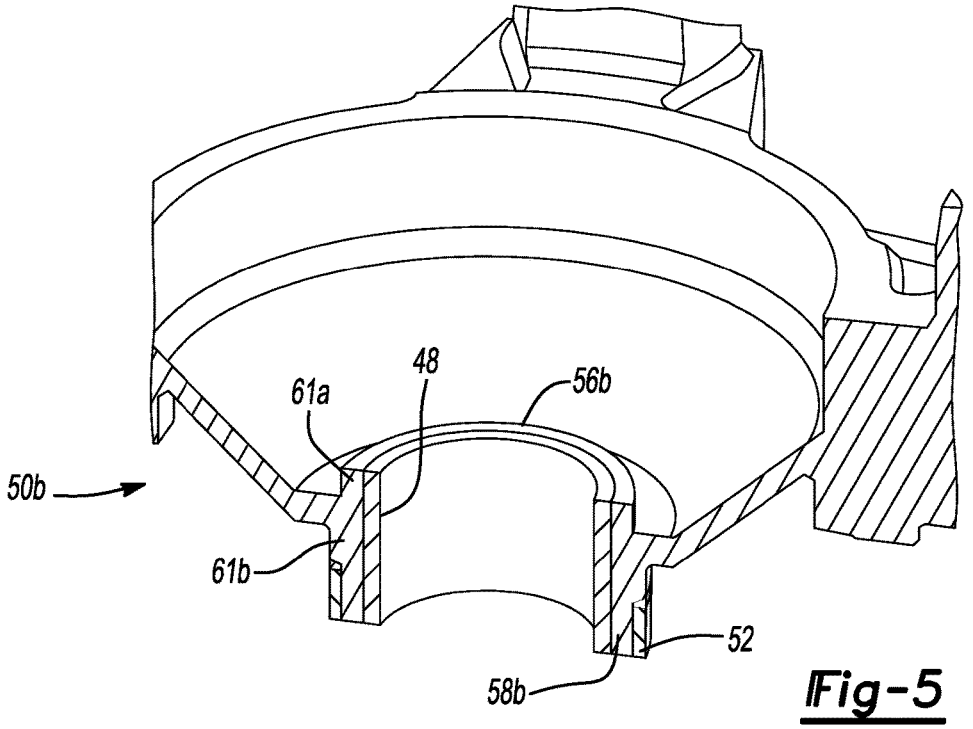
FIG. 5 is a partial cross-sectional view of another configuration of a main bearing housing of the compressor of FIG. 1, including a bearing collar.

As illustrated in FIG. 1, in one configuration of the bearing housing 50, the first portion 56 and the second portion 58 may extend axially upward (relative to the view in FIG. 1) in the direction of the compression mechanism 16. As illustrated in FIG. 4, in another configuration of a bearing housing **50*a*, the first portion 56*a* and the second portion 58*a* may extend axially downward in the direction of the motor assembly 14. As illustrated in FIG. 5, in yet another configuration of a bearing housing 50*b*, a first segment 61*a* of the first portion 56*b* may extend axially upward from the bearing housing 50*b* and a second segment 61*b* of the first portion 56*b* may extend axially downward from the bearing housing 50*b*. The second portion 58*b* may extend axially downward from the second segment 61*b***.

The bearing insert 48 may be concentrically mounted within the hub 54, and may rotatably support the drive shaft 30. The bearing insert 48 may be a substantially cylindrical steel sleeve having an outer diameter D4. The outer diameter D4 of the bearing insert 48 may be larger than the inner diameter D1 of the hub 54. Accordingly, mounting the bearing insert 48 within the hub 54 may create an interference fit, and generate a compressive force component F1, between the bearing insert 48 and the hub 54. For example, the outer diameter D4 of the bearing insert 48 may be between 0.05 and 0.15 millimeters larger than the inner diameter D1 of the hub 54. In one configuration, the outer diameter D4 is approximately 0.08 millimeters (3.2 mils) larger than the inner diameter D1. Accordingly, the bearing insert 48 may be press-fit (e.g., cold press) within the hub 54 by applying a force in the axial direction on either or both of the insert 48 and the hub 54.

Figure 7:
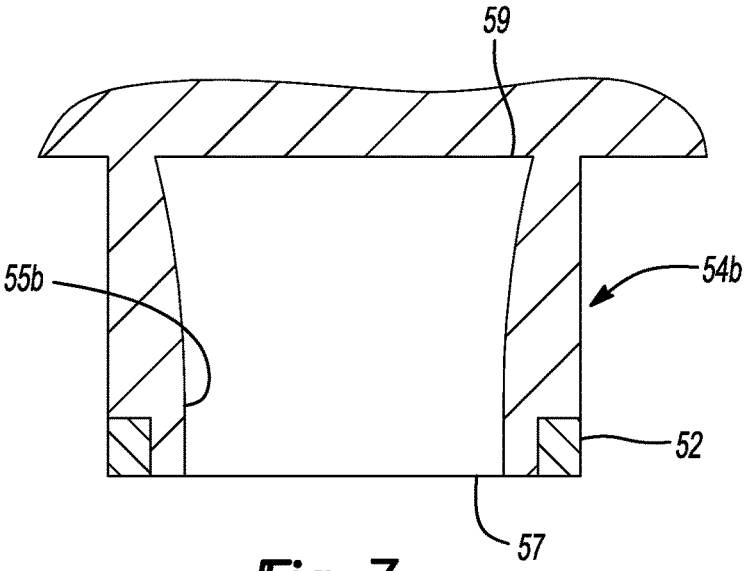
FIG. 7 is a partial cross-sectional view of another configuration of a hub of the orbiting scroll of FIG. 6.

The bearing collar 52 may be constructed of steel or any other suitable material, and may be mounted annularly about the second portion 58 of the hub 54. While the bearing collar 52 is generally shown and described herein as being mounted annularly about the hub 54 of the bearing housing 50, it will also be appreciated that the bearing collar 52 may be mounted annularly about a hub located on another support structure within the compressor 10. For example, the with reference to FIG. 6, the compressor 10 may include an orbiting scroll member 36*a*. The orbiting scroll member 36*a* may be substantially similar to the orbiting scroll member 36, except as otherwise provided herein. The orbiting scroll member 36*a* may include a hub 54*a* defining a bore 55*a*. The hub 54*a* may be substantially similar to the hub 54. Accordingly, only the hub 54 will be described herein. The bearing collar 52 may be mounted annularly about the hub 54*a* of the orbiting scroll member 36*a*. In addition, the bearing insert 48 may be mounted within the bore 55*a* of the orbiting scroll member 36*a*. With reference to FIG. 7, in another configuration, a hub 54*b* may define a bore 55*b* having a diameter that varies from a first end 57 of the bore 55*b* to a second end 59 of the bore 55*b*, such that the bore 55*b* is generally frustoconically shaped. It will be appreciated that the frustoconical shape of bore 55*b* may be included in any of the bore configurations taught herein, including the bore 55 of the bearing housing 50.

As illustrated, in one configuration, the bearing collar 52 may be a substantially cylindrical member defining an inner diameter D5. In one configuration the inner diameter D5 of the bearing collar 52 may be less than the outer diameter D3 of the second portion 58 of the hub 54, such that mounting the bearing collar 52 on the second portion 58 creates an interference fit between the bearing collar 52 and the second portion 58. It is also understood that the bearing collar 52 may be crimped or otherwise compressed onto the second portion 58, thus creating an interference fit between the bearing collar 52 and the second portion 58. In another method of assembling the bearing collar 52 and the hub 54, the diameter D5 of the bearing collar 52 may be increased by a heating process and/or the diameter D3 of the hub 54 may be reduced by a cooling process to allow the bearing collar 52 to be placed on the hub 54 without interference therebetween. Upon temperature equalization of the bearing collar 52 and the hub 54, an interference fit may be generated between the bearing collar 52 and the hub 54.

The interference fit between the bearing collar 52 and the second portion 58 of the hub 54 may generate a compressive force component F2 on the second portion 58 of the hub 54. The force component F2 may decrease the diameter D3 of the second portion 58 and decrease the inner diameter D1 of the hub 54, thus increasing the compressive force component F1 between the hub 54 and the bearing insert 48. The force component F2 on second portion 58 of the hub 54 may improve the retention of the bearing insert 48 within the hub 54. Accordingly, it will be understood that in one method of assembling the bearing housing assembly 18, the bearing insert 48 may be disposed within the hub 54 before the bearing collar 52 is disposed about the hub 54.

Figure 8:
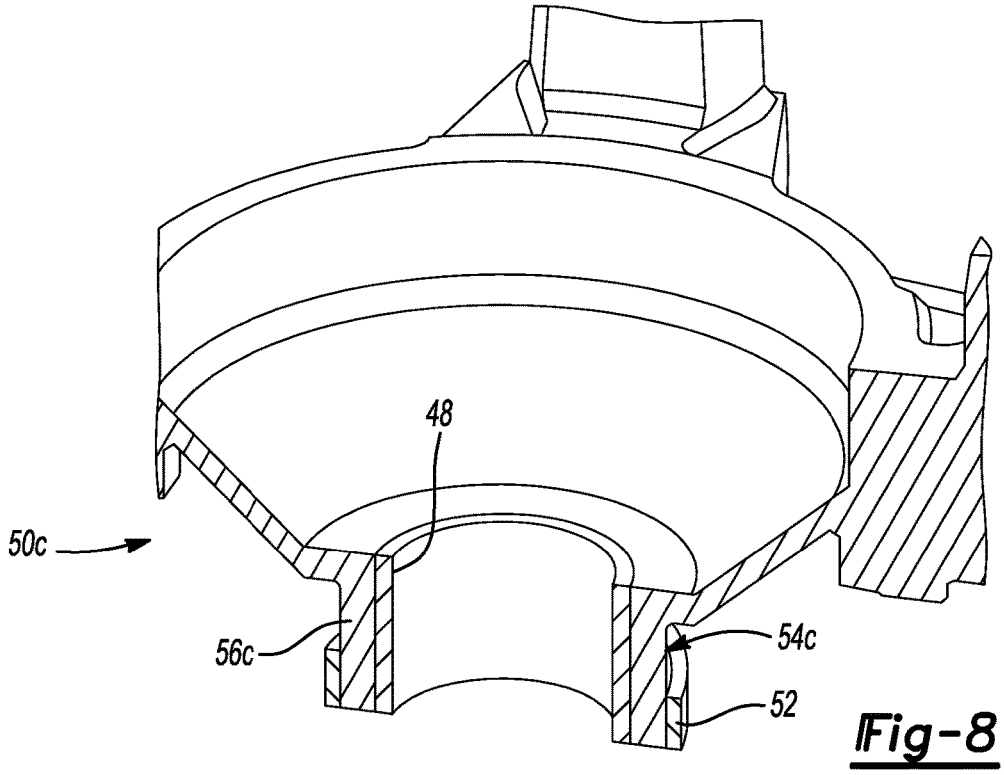
FIG. 8 is a partial cross-sectional view of another configuration of a main bearing housing of the compressor of FIG. 1, including a bearing collar.

While the hub 54 is generally described herein as including first and second portions 56, 58, it will also be appreciated that in another configuration (FIG. 8), a hub 54*c* may include a first portion 56*c*. The hub 54*c* and the first portion 56*c* may be substantially similar to the hub 54 and first portion 56, respectively, except as otherwise provided herein. In the configuration shown in FIG. 8, the bearing collar 52 may be annularly disposed about the first portion 56*c* of the hub 54*c* in the manner previously described herein.

The materials of the hub 54 and the bearing collar 52 may influence the magnitude of forces F1 and F2. For example, constructing the bearing collar 52 from a material with a higher elastic modulus (e.g. steel) and constructing the hub 54 from a material with a lower elastic modulus (relative to the bearing collar 52) may increase the magnitude of the force component F2. Where space limits the thickness of bearing collar 52, a higher elastic modulus material may improve the retention of the bearing insert 48 within the hub 54.

As the drive shaft 30 rotates about the axis 31, it may apply a torque on the bearing insert 48, and urge the bearing insert 48 to rotate about the axis 31. A frictional force between the bearing insert 48 and the hub 54, generally associated with the first compressive force component F1, may resist movement of the bearing insert 48 relative to the hub 54. Introduction of the second compressive force component F2 may increases the first compressive force component F1, which in turn may operate to prevent the bearing insert 48 from rotating or otherwise moving relative to the hub 54.

FIG. 9*a* illustrates a cross-sectional view of an orbiting scroll member 01 of a compressor 03 (not illustrated in Figures) with a hub 02 extending therefrom and with a bearing insert 04 assembled thereto in accordance with the prior art.

FIG. 9*b* illustrates a cross-sectional view of an orbiting scroll member 36 of the compressor 10 with a hub 54 extending therefrom is illustrated, wherein the hub 54 has a stepped end "S" for facilitating mounting of a bearing collar 52 thereon, further, the hub 54 includes an axially extending aperture 55 for receiving a bearing insert 48 therein. The bearing insert 48 is press fitted inside the axially extending aperture 55 of the hub 54. The step "S" configured on the end of the hub 54 is configured by machining. FIG. 9*c* illustrates an arresting arrangement 100 that arrests any relative movement between the bearing insert 48 and the hub 54 supporting a drive shaft of the compressor 10. More specifically, FIG. 9*c* illustrates an assembly of the bearing collar 52 on the stepped end of the hub 54 of the orbiting scroll member 36 in case of the drive bearing assembly of the present disclosure. The bearing collar 52, also referred to as retainer ring, of steel material, is press fitted over the stepped end "S" of the scroll hub 54. More specifically, the orbiting scroll member 36, particularly, the scroll hub 54 is of cast iron that is machined on the outer diameter (OD) and then a DU drive bearing insert 48 is press-fitted in the inner diameter (ID) of the scroll hub 54. Thereafter, the steel retainer ring 52 is press-fitted on the outer diameter (OD) of scroll hub 54. With such a configuration of the arresting arrangement for the drive bearing assembly, particularly, with the arrangement of the retainer ring 52 press-fitted on the outer diameter (OD) of scroll hub 54, additional reinforcement on the bearing insert 48 is ensured, thereby ultimately ensuring no spinning, walking-in or walking-out of the bearing insert 48. Further, with such a configuration of the arresting arrangement for the drive bearing assembly, the bearing press force is not increasing and in-fact will be less as compared to the bearing press force encountered in case of the conventional arresting arrangement for the drive bearing assembly.

The retainer ring 52 (as illustrated in FIG. 9*c*) disposed outside the hub 54 prevents any movement of the bearing insert 48 with respect to the hub 54, thereby completely restricting the spinning, walking-in or walking-out of bearing insert 48. More specifically, the steel retainer ring 52 provides additional and effective reinforcement on the scroll hub 54. By using the retainer ring 52, the retainer ring 52 acts as a reinforcement ring that helps to arrest the drive bearing spinning and walking-in/walking-out phenomenon. It has been observed that with use of the present arresting arrangement 100, that arrests any relative movement between the bearing and the hub supporting the drive shaft of the drive bearing assembly of the compressor, the performance of the drive bearing assembly of the present disclosure is better than the performance of the conventional drive bearing assembly. Typically the extending collar (of retainer ring 52) inwardly arrests walking-out/walking-in/spin of bearing insert 48.

FIG. 10*a* illustrates a schematic representation of the compressor 03 having the orbiting scroll member 01 with the hub 02 extending therefrom in accordance with the prior art. FIG. 10*b* illustrates a schematic representation of the compressor 10 having the orbiting scroll member 36 with the hub 54 extending therefrom in accordance with the present disclosure.

FIG. 11*a* illustrates a sectional view of an orbiting scroll member 01 of a compressor 03 (not illustrated in Figures) with the hub 02 extending therefrom and with a bearing insert 04 assembled thereto in accordance with the prior art, particularly, the axially extending aperture 05 configured in the hub 02 receives the bearing insert 04, particularly, the DU bearing 04 is press-fitted inside the axially extending aperture 05 configured in the hub 02.

FIG. 11*b* illustrates an arresting arrangement 200 in accordance with another embodiment that arrests any relative movement between a bearing insert 148 and a hub 154 supporting a drive shaft of the compressor 10. FIG. 11*b* illustrates a sectional view of an orbiting scroll member 136 of the compressor 10 with the hub 154 extending therefrom and with the bearing insert 148 assembled thereto, particularly, the axially extending aperture 155 configured in the hub 154, receives the bearing insert 148 therein and a lock nut 153 and a tapered retaining ring 159 are mounted for retaining the bearing insert 148 within the axially extending aperture 155. FIG. 11*c* illustrates an enlarged view depicting an end portion of the hub 154, wherein the hub 154 has a threaded end and slots 151 are configured on the inside surface at the end of the hub 154 for arresting rotation of the bearing insert 148. FIG. 11*d* illustrates an enlarged view of the retainer ring 159, wherein protruding legs 161 are configured on outer periphery of the retainer ring 159 that engage with the slots 151 of the hub 154 to configure an interference fit between the retainer ring 159 and the hub 154.

The tapered retainer ring 159 (as illustrated in FIG. 11*b*) disposed inside the hub 154 prevents any movement of the bearing insert 148 with respect to the hub 154, thereby completely restricting the spinning, walking-in and walking-out of bearing insert 148. More specifically, the steel retainer ring 159 provides additional and effective reinforcement on the scroll hub 154. By using the retainer ring 159, the retainer rings 159 acts as a reinforcement ring that helps to arrest the drive bearing spinning and walking-in/walking-out phenomenon. It has been observed that with use of the present arresting arrangement that arrests any relative movement between the bearing and the hub supporting a drive shaft of the drive bearing assembly of the compressor, the performance of the drive bearing assembly of the present disclosure is better than the performance of the conventional drive bearing assembly.

FIG. 12*a* illustrates a sectional view of an orbiting scroll member 236 of the compressor 10 with a hub 254 extending therefrom and a bearing insert 248 received inside the axially extending aperture 255 of the hub 254, wherein an elliptical retainer 266 is used as an arresting arrangement 300 in accordance with yet another embodiment. FIG. 12*b* illustrates an isometric view of the elliptical retainer 266, wherein the elliptical retainer 266 has legs/prongs that lock with scroll hub 254 after assembly due to friction, the elliptical retainer 266 also has very small projections between the legs 268. FIG. 12*c* illustrates an enlarged view of the elliptical retainer 266, wherein the micro projections configured on the elliptical retainer 266 are depicted. The micro projections configured on the elliptical retainer 266 are giving additional anti-rotation support. The legs 268 fold into the hub 254 and the micro projections/protrusions lock into the hub diametrical face giving anti-rotation support. The bottom face of the bearing insert 248 also has a taper. The proposed tapered retainer ring 266 mates with the bearing 248 after press fit assembly and holds the bearing 248 in place and restricts spinning and axial walk out, and helps in increasing retention.

Referring to FIG. 12-12*c*, the elliptical inclined retainer 266 has a plurality of extending legs/prongs 268 locking with scroll hub 254 after assembly due to friction. While pressing the elliptical retainer ring 266 in an inclined position against the tapered face of the insert into hub inner diameter, the legs/prongs 268 get folded downward into the hub 254 against hub inner diameter thereby restricting walk-out of insert. The retainer ring 266 also has micro projections between the legs 268. While pressing the inclined retainer 266, these micro projections give additional anti-rotation support. The legs 268 fold into the hub 254 and the micro projections lock into the hub diametrical face giving anti-rotation support. The bottom face of the bearing insert 248 has a taper. The proposed inclined retainer ring 266 mates with the tapered bearing 248 after press fit assembly and holds the bearing 248 in place and restricts spinning and axial walk out, and helps in increasing retention.

FIG. 13 illustrates an isometric view of an arresting arrangement 400 in accordance with yet another embodiment, wherein a step 467 is provided at inside wall at the bottom end of the hub 454 extending from the orbiting scroll member 436 of the compressor 410 (not illustrated in Figures), wherein the bearing insert 448 snap fits into the step 467 configured at inner wall of the hub 454 at the bottom end thereof, thereby preventing bearing walk-out. Compressor 410 may be similar to compressor 10 and may include the same or similar features as compressor 10 other than those features described herein.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a shell;

a compression mechanism disposed within said shell;

a drive shaft drivingly engaged with the compression mechanism;

a bearing housing engaged with said compression mechanism;

a hub disposed within said shell and defining an axis of rotation, said hub including an axially extending aperture, said drive shaft engaged with said axially extending aperture;

a motor assembly driving said drive shaft about said axis of rotation;

a bearing insert disposed within said aperture and rotatably supporting said drive shaft; and at least one collar disposed about said hub, wherein said at least one collar is mounted on said hub to create an interference fit between the at least one collar and the hub and retain the at least one collar on the hub.

2. The compressor of claim 1, further comprising a drive shaft rotatably mounted within said bearing insert.

3. The compressor of claim 1, wherein said collar is an annular collar having an inner diameter, and said hub has an outer diameter that is larger than said inner diameter.

4. The compressor of claim 3, wherein said collar is press-fit on said hub.

5. The compressor of claim 1, wherein said bearing insert is a cylindrical insert having an outer diameter, and said aperture has an inner diameter that is smaller than said outer diameter.

6. The compressor of claim 5, wherein said bearing insert is press-fit within said aperture.

7. The compressor of claim 1, wherein said bearing insert is operable to rotate within said aperture about the axis of rotation.

8. The compressor of claim 1, wherein said hub further includes an axially extending recessed portion disposed about said aperture, and wherein said collar is disposed about said recessed portion.

9. The compressor of claim 1, wherein said collar includes a radially inwardly extending portion configured to restrain relative movement between said bearing insert and said hub.

10. The compressor of claim 1, wherein said collar comprises a lock nut and a retaining ring configured to engage said bearing insert, said retaining ring having protruding legs configured to engage an inner periphery of said hub, and said lock nut configured to engage with threads formed on an outer periphery of said hub and adapted to secure said retainer ring relative to said hub and further adapted to secure said bearing insert within said hub.

11. A compressor comprising:

a shell;

a compression mechanism disposed within said shell;

a drive shaft drivingly engaged with the compression mechanism;

a support structure disposed within said shell and engaged with said compression mechanism, said support structure including a central hub defining an axis of rotation and including a first axially extending portion having a first outer diameter, and a second axially extending portion having a second outer diameter;

a motor assembly driving said drive shaft about said axis of rotation;

a bearing insert concentrically disposed within said central hub and rotatably supporting said drive shaft; and at least one collar concentrically disposed about said second axially-extending portion.

12. The compressor of claim 11, wherein said second outer diameter is less than said first outer diameter.

13. The compressor of claim 11, further comprising a drive shaft rotatably mounted within said bearing insert.

14. The compressor of claim 11, wherein said collar is an annular collar having an inner diameter, and said second outer diameter is larger than said inner diameter.

15. The compressor of claim 14, wherein said collar is press-fit on said second axially extending portion of the hub.

16. The compressor of claim 11, wherein said bearing insert is a cylindrical insert having an outer diameter, and said central hub includes an aperture having an inner diameter that is smaller than said outer diameter.

17. The compressor of claim 16, wherein said bearing insert is press-fit within said aperture.

18. The compressor of claim 11, wherein said central hub includes an aperture, and wherein said bearing insert is operable to rotate within said aperture about the axis of rotation.

19. The compressor of claim 11, wherein the support structure is a bearing housing.

20. The compressor of claim 11, wherein the support structure is an orbiting scroll member.

21. The compressor of claim 11, wherein said first axially extending portion has a first wall thickness and said second axially extending portion has a second wall thickness not less than one-half of said first wall thickness.

* * * * *